US007972990B2

(12) United States Patent
Iino et al.

(10) Patent No.: US 7,972,990 B2
(45) Date of Patent: Jul. 5, 2011

(54) PROCESS FOR RECORDING INTO REWRITABLE RECORDING MEDIUM OF NON-CONTACT TYPE

(75) Inventors: Chisato Iino, Koshigaya (JP); Tetsuyuki Utagawa, Kawaguchi (JP); Takehiko Nishikawa, Saitama (JP)

(73) Assignee: Lintec Corporation, Tokyo (JP)

( * ) Notice: Subject to any disclaimer, the term of this patent is extended or adjusted under 35 U.S.C. 154(b) by 896 days.

(21) Appl. No.: 11/895,944

(22) Filed: Aug. 28, 2007

(65) Prior Publication Data

US 2008/0064596 A1 Mar. 13, 2008

(30) Foreign Application Priority Data

Sep. 7, 2006 (JP) ..... 2006-242620

(51) Int. Cl.
*B41M 5/30* (2006.01)

(52) U.S. Cl. ..... 503/201; 430/945

(58) Field of Classification Search ..... None
See application file for complete search history.

(56) References Cited

U.S. PATENT DOCUMENTS

| | | | |
|---|---|---|---|
| 4,873,413 | A | 10/1989 | Uesugi et al. |
| 6,956,010 | B2 | 10/2005 | Tsukida et al. |
| 2003/0235128 | A1 | 12/2003 | Sasaki et al. |
| 2005/0019695 | A1 | 1/2005 | Kojima et al. |
| 2005/0170960 | A1 | 8/2005 | Tsukida et al. |
| 2006/0221424 | A1 | 10/2006 | Utagawa et al. |
| 2007/0036039 | A1 | 2/2007 | Kawahara et al. |

FOREIGN PATENT DOCUMENTS

| | | | |
|---|---|---|---|
| EP | 1 752 298 | A1 | 2/2007 |
| EP | 1 834 795 | A1 | 9/2007 |
| JP | 62-239325 | A | 10/1987 |
| JP | 8-267797 | A | 10/1996 |
| JP | 2002-215038 | A | 7/2002 |
| JP | 2003-118238 | A | 4/2003 |
| JP | 2003-127446 | A | 5/2003 |
| JP | 2003-320694 | A | 11/2003 |
| JP | 2003-320695 | A | 11/2003 |
| JP | 2004-90026 | A | 3/2004 |
| JP | 2004-94510 | A | 3/2004 |
| JP | 2004-168024 | A | 6/2004 |

OTHER PUBLICATIONS

European Search Report for EP 07 11 4954 dated Mar. 12, 2010.

(Continued)

*Primary Examiner* — Bruce H Hess

(74) *Attorney, Agent, or Firm* — Holtz, Holtz, Goodman & Chick, P.C.

(57) ABSTRACT

In a process for recording into a rewritable recording medium of a non-contact type, when adjacent lines or adjacent overlapping lines are drawn by scanning the medium having a reversible heat sensitive color developing layer on a substrate with laser light and a second line 2 is drawn after a first line 1 is drawn, the time between the start of drawing 1 and the end of drawing 2 and/or the width of the overlapped portion r is controlled as the means for suppressing discoloration of the recorded lines by interference between heat remaining after 1 has been drawn and heat generated while 2 is drawn. When characters, bar codes, solid images or figures are drawn into a rewritable recording medium of the non-contact type by scanning with laser light, excellent readability and visibility of the bar codes can be obtained in recording a plurality of line elements.

8 Claims, 2 Drawing Sheets

OTHER PUBLICATIONS

J. Siegel et al, "Rewritable phase-change optical recording in Ge2Sb2Te5 films induced by pico-second laser pulses," *Applied Physics Letters*, vol. 84, No. 13, Mar. 19, 2009.

J. Solis et al, "Ultra-short-laser-pulse-driven rewritable phase-change optical recording in Sb-based films," *Applied Physics A* (*Materials Science Processing*, Mar. 2003, Springer-Verlag Germany* (abstract only enclosed).

PROCESS FOR RECORDING INTO REWRITABLE RECORDING MEDIUM OF NON-CONTACT TYPE

TECHNICAL FIELD

The present invention relates to a process for recording into a rewritable recording medium of the non-contact type. More particularly, the present invention relates to a process for recording into a rewritable recording medium of the non-contact type wherein, when a plurality of line elements which are adjacent to each other or are adjacent to each other and overlapping each other are recorded in a recording process for drawing characters, bar codes, solid images or figures into the rewritable recording medium of the non-contact type by scanning with laser light, discoloration of line elements is suppressed, and decreases in readability and visibility of bar codes, for example, can be suppressed.

BACKGROUND ART

As the label for control of articles such as labels attached to plastic containers used for transporting foods (returnable containers), labels used for control of electronic parts and labels attached to cardboard boxes for control of distribution of articles, currently, labels having a heat-sensitive recording material are mainly used.

In the heat sensitive recording material, a heat-sensitive recording layer containing an electron-donating dye precursor which is, in general, colorless or colored slightly and an electron-accepting color developing agent as the main components is formed on a support. Rewritable labels which allows formation of an image, erasure of the formed image and rewriting of another image are increasingly used recently. When it is desired that the label attached to an adherend is treated for rewriting without detaching the label from the adherend, the erasure of the recorded image and the rewriting of another image cannot be conducted by passing through an ordinary printer since the label remains attached to the adherend. To conduct the desired treatment, it is necessary that the erasure and the rewriting of images be conducted without contacting the label.

For the repeated use of a label, in recent years, reversible heat sensitive recording materials which allows formation and erasure of images, such as (I) a reversible heat sensitive recording material having a heat sensitive layer which is formed on a substrate and contains a resin and an organic low molecular weight substance showing reversible changes in transparency depending on the temperature and (II) a reversible heat sensitive recording material having a heat sensitive color developing layer which is formed on a substrate and contains a dye precursor and a reversible color developing agent, have been developed.

Among the above reversible heat sensitive recording materials, reversible heat sensitive recording material (II) is more widely used. However, the heat sensitive color developing layer in the above heat sensitive recording material has a drawback in that the surface of the label is destroyed or the developed color is lost to decrease the density of recording and the visibility when the surface is subject to a specific heat history, specifically, when the surface irradiated with laser light is irradiated again or a plurality of line elements are recorded while the surface is at a temperature in a specific range. Due to this drawback, a problem arises in that, when a one-dimensional bar code or a solid image constituted with a plurality of line elements is formed, the density of color in a potion where the color development has been made decreases due to heat generated in surrounding portions, and readability and visibility of the bar code decrease. A further problem on the formation of an image arises in that, when the time between the end of drawing the line in the previous step and the start of drawing the line in the next step is extremely short, the starting point of the line drawn in the previous step does not conform to the starting point of the line drawn in the next step, and a clear image is not formed. Due to this problem, visibility becomes insufficient, and readability of the bar code decreases.

[Patent Reference 1] Japanese Patent Application Laid-Open No. 2003-118238

[Patent Reference 2] Japanese Patent Application Laid-Open No. 2003-320694

DISCLOSURE OF THE INVENTION

The present invention has an object of providing a process for recording into a rewritable recording medium of the non-contact type which provides excellent readability and visibility of a bar code when a plurality of line elements are recorded in a recording process for drawing characters, bar codes, solid images or figures into the rewritable recording medium of the non-contact type by scanning with laser light.

As the result of intensive studies by the present inventors to achieve the above object, it was found that, when lines which are adjacent to each other or are adjacent to each other and overlapping each other are drawn by scanning a rewritable recording medium of the non-contact type having a reversible heat sensitive color developing layer disposed on the surface of a substrate with laser light, and a second line is drawn after a first line is drawn, the object could be achieved by a means for suppressing discoloration of the recorded lines by interference between heat remaining after the first line has been drawn and heat generated while the second line is drawn, the means being (1) scanning with laser light in a manner such that, when lines which are adjacent to each other or are adjacent to each other and overlapping each other are drawn by scanning with laser light, and a second line is drawn after a first line is drawn, the scanning with laser light is conducted in a manner such that the time between start of drawing the first line and end of drawing the second line is controlled within a specific range or (2) by scanning with laser light in a manner such that when lines which are adjacent to each other and overlapping each other are drawn by scanning with laser light, and a second line is drawn after a first line is drawn, the scanning with laser light is conducted in a manner such that the width of an overlapped portion between the first line and the second line is controlled within a specific range.

It was also found that the property for recording could be further improved when Virtual scanning/Passing-through Mode was used as the mode of scanning with laser light since no excessive energy of laser light is applied at the starting point and the ending point of the lines.

It was also found that the property for recording could be further improved when the reversible heat sensitive color developing layer comprises an agent for light absorption and heat conversion or a light absorption and heat conversion layer comprising an agent for light absorption and heat conversion is disposed on the reversible heat sensitive color developing layer, and the light absorption rate of laser light at the surface of the recording medium was 40% or greater.

The present invention has been completed based on the above knowledge.

The present invention provides:

[1] A process for recording into a rewritable recording medium of a non-contact type which comprises, when lines which are adjacent to each other or are adjacent to each other and overlapping each other are drawn by scanning a rewritable recording medium of a non-contact type having a reversible heat sensitive color developing layer disposed on a surface of a substrate with laser light, and a second line is drawn after a first line is drawn, controlling a time between start of drawing the first line and end of drawing the second line and/or a width of an overlapped portion between the first line and the second line as a means for suppressing discoloration of the recorded lines by interference between heat remaining after the first line has been drawn and heat generated while the second line is drawn;

[2] The process for recording into a rewritable recording medium of a non-contact type described in [1], wherein, when lines which are adjacent to each other or are adjacent to each other and overlapping each other are drawn by scanning with laser light, and a second line is drawn after a first line is drawn, the scanning with laser light is conducted in a manner such that the time between start of drawing the first line and end of drawing the second line is 0.2 to 34 msec;

[3] The process for recording into a rewritable recording medium of a non-contact type described in any one of [1] and [2], wherein, when lines which are adjacent to each other and overlapping each other are drawn by scanning with laser light, and a second line is drawn after a first line is drawn, the scanning with laser light is conducted in a manner such that the width of an overlapped portion between the first line and the second line is 0 to 60 μm;

[4] The process for recording into a rewritable recording medium of a non-contact type described in any one of [1] to [3], wherein the scanning with laser light is conducted by using an apparatus for scanning with light comprising a source of laser light, a scanning mirror which can be driven for rotation and is used for scanning with the laser light emitted from the source by the oscillation and an optical system for correction of the focal distance to focus the laser light projected for the scanning by the scanning mirror and in a manner such that when a prescribed drawing is conducted by irradiation of a rewritable recording medium with laser beam, the scanning mirror is continuously driven, and the actual drawing is conducted by activating oscillation of the laser light and scanning with the laser light only when the locus of the laser beam supposed to be formed if the oscillation of the laser light would be activated (the virtual laser beam) is moving substantially at a constant speed;

[5] The process for recording into a rewritable recording medium of a non-contact type described in any one of [1] to [4], wherein the rewritable recording medium of a non-contact type comprises an agent for light absorption and heat conversion comprised in the reversible heat sensitive color developing layer or a light absorption and heat conversion layer comprising an agent for light absorption and heat conversion disposed on the reversible heat sensitive color developing layer, and has a light absorption rate of laser light at a surface of the recording medium of 40% or greater, said light absorption rate of laser light being calculated from the following formula:

$$100\% - (\text{percent transmittance} + \text{percent reflectance}) = \text{absorbtion rate of laser light}(\%),$$

wherein the percent transmittance and the percent reflectance are values determined in accordance with JIS K0115 for the laser light used for the recording; and

[6] The process for recording into a rewritable recording medium of a non-contact type described in any one of [1] to [5], wherein the rewritable recording medium of a non-contact type comprises an adhesive layer disposed on a surface of the substrate opposite to a face having the reversible heat sensitive color developing layer.

EFFECT OF THE INVENTION

In accordance with the process for recording into a rewritable recording medium of a non-contact type of the present invention, discoloration of line elements is suppressed, and decreases in readability and visibility of bar codes, for example, can be suppressed when a plurality of line elements which are adjacent to each other or are adjacent to each other and overlapping each other are recorded.

Figure 1:
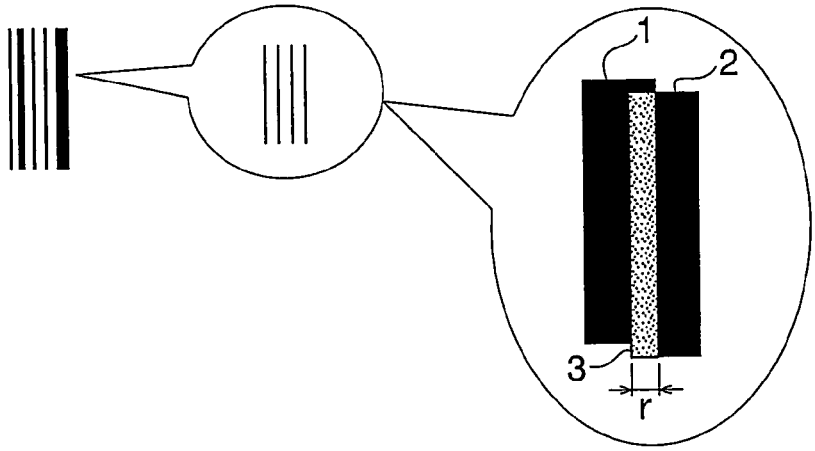
FIG. 1 (A), FIG. 1 (B) and FIG. 1 (C) show diagrams describing a process for recording individual lines in a broad line of a bar code.

In the Figures, reference numerals mean as follows: 1: a first line, 2: a second line, 3: an overlapped portion, and r: the width of an overlapped portion.

THE MOST PREFERRED EMBODIMENT TO CARRY OUT THE INVENTION

The process for recording into a rewritable recording medium of a non-contact type of the present invention (occasionally, referred to simply as a rewritable recording medium or a recording medium) is characterized in that the process comprises, when lines which are adjacent to each other or are adjacent to each other and overlapping each other are drawn by scanning a rewritable recording medium of a non-contact type having a reversible heat sensitive color developing layer disposed on the surface of a substrate with laser light, and a second line is drawn after a first line is drawn, controlling the time between the start of drawing the first line and the end of drawing the second line and/or the width of an overlapped portion between the first line and the second line as a means for suppressing discoloration of the recorded lines by interference between heat remaining after the first line has been drawn and heat generated while the second line is drawn.

The preferable embodiment of the recording process of the present invention include (1) an embodiment in which, when lines which are adjacent to each other or are adjacent to each other and overlapping each other are drawn by scanning with laser light, and a second line is drawn after a first line is drawn, the scanning with laser light is conducted in a manner such that the time between the start of drawing the first line and the end of drawing the second line is 0.2 to 34 msec (hereinafter, referred to as recording process 1); and (2) an embodiment in which, when lines which are adjacent to each other and overlapping each other are drawn by scanning with laser light, and a second line is drawn after a first line is drawn, the scanning with laser light is conducted in a manner such that the width of an overlapped portion between the first line and the second line is 0 to 60 μm (hereinafter, referred to as recording process 2).

In the recording process of the present invention, an image such as a character, a bar code, a solid image and a figure is drawn and recorded into a rewritable recording medium by scanning with laser light. The scanning with laser light means that, using an apparatus for scanning with light, laser light is generated by oscillation, and a rewritable recording medium is irradiated with a focused laser beam obtained from the generated light in a manner such that a prescribed image is drawn.

The apparatus for scanning with light is not particularly limited. For example, an apparatus comprising a source of laser light, a scanning mirror which can be driven for rotation and is used for scanning with the laser light emitted from the source by the oscillation and an optical system for correction of the focal distance to focus the laser light projected for the scanning by the scanning mirror, can be used.

Since, in general, a near infrared laser light having a wavelength in the range of 700 to 1,400 nm is used as the source of laser light in the apparatus for scanning with light, any apparatus can be used as the source of the laser light in the optical scanning apparatus used in the present invention as long as laser light having a wavelength in the above range can be obtained by oscillation. Semiconductor lasers (830 nm) and YAG lasers (1,064 nm) are preferable although the apparatus is not particularly limited.

As the scanning mirror which can be driven for rotation and is used for scanning with laser light emitted from the source by oscillation, a galvanomirror, a polygon mirror or a resonant mirror can be used. The galvanomirror is a mirror having a magnet and controlled by an outside magnetic field. The polygon mirror is a mirror of a polygon which is rotated. The resonant mirror is a mirror used under the same principle as that for the galvanomirror except that the mirror is driven at a resonance frequency.

In the optical scanning apparatus, for example, an optical system using an f-θ lens can be used as the optical system for correction of the focal distance which is used for focusing the laser light projected for scanning by the scanning mirror.

Recording process (1) in the present invention is applied to drawing lines which are adjacent to each other or are adjacent to each other and overlapping each other.

In recording process (1), it is preferable that, when lines which are adjacent to each other or are adjacent to each other and overlapping each other are drawn by scanning with laser light, and a second line is drawn after a first line is drawn, the scanning with laser light is conducted in a manner such that the time between the start of drawing the first line and the end of drawing the second line is 0.2 to 34 msec.

When the time for the drawing is 0.2 msec or longer, the time interval from the time the first line was drawn to the time the second line is drawn is not excessively short, and the speed of the scanning mirror such as a galvanomirror can respond to the prescribed speed (on-and-off of the laser light can be suitably conducted), and destruction of the substrate at the time of starting the drawing and at the time of ending the drawing can be suppressed. Fluctuation in the timing of the start of drawing individual broad lines can be suppressed, and clear images can be obtained. Even when scanning with Virtual scanning/Passing-through Mode, which will be described later, is not used, destruction of the substrate at the starting point and the ending point by heat is suppressed. On the other hand, when the time for the drawing is 34 msec or shorter, the timing of drawing the second line is made different from the timing when the remaining heat (the accumulated heat) formed by drawing the first line in the previous step and the heat generated by the drawing of the second line work interdependently to reach a condition in which the color of the first line tends to be eliminated, and a decrease in the density of color in the portion having a developed color due to the heat in the surrounding portion can be suppressed. Therefore, for example, excellent readability and visibility of bar codes can be obtained. It is more preferable that the time for the drawing described above is 0.3 to 30 msec and still more preferably 0.3 to 25 msec.

Recording process (1) can be applied to drawing characters, bar codes, solid images and figures.

FIG. 1 (A), FIG. 1 (B) and FIG. 1 (C), show diagrams describing a process for recording individual lines in a broad line of a bar code. A broad line is drawn with a plurality of narrow lines adjacent to each other. FIG. 1 (A) shows a one-dimensional bar code, FIG. 1 (B) shows an expanded diagram of a broad line in the one-dimensional bar code, and FIG. 1 (C) shows a further expanded diagram of the broad line shown in FIG. 1 (B). The reference numerals mean as follows: 1: a first line, 2: a second line which overlaps the first line and is adjacent thereto, 3: an overlapped portion, and r: the width of an overlapped portion.

In recording process 1, it is preferable that the laser light is used for the scanning in a manner such that the time between the start of drawing the first line and the end of drawing the second line is 0.2 to 34 msec.

As the mode of scanning with laser light, any of Virtual scanning/Passing-through Mode described in the following or a conventional scanning mode may be used. The Virtual scanning/Passing-through Mode is preferable since irradiation with an excessive amount of laser energy in areas in the vicinity of the start of a line (the starting point) and the end of a line (the ending point) can be prevented and degradation in the substrate can be suppressed.

In the present invention, when a conventional scanning mode which is not Virtual scanning/Passing-through Mode is used, acceleration and deceleration of the driving of scanning mirror take place in areas in the vicinity of the start of a line (the starting point) and the end of a line (the ending point) since the driving of the scanning is stopped at the starting point and at the ending point. Since the irradiation with the laser beam is kept at the constant output during the period of the acceleration and the deceleration, the starting point and the ending point are irradiated with a greater amount of the laser energy than that of other portions of the locus, and the degradation of the substrate tends to takes place more easily than scanning with Virtual scanning/Passing-through Mode. In the present invention, "Virtual scanning/Passing-through Mode" means a mode of scanning with laser light in which, when a prescribed drawing is conducted by irradiation of a rewritable recording medium with laser beam using an apparatus for scanning with light comprising a source of laser light, a scanning mirror which can be driven for rotation and is used for scanning with the laser light emitted from the source by the oscillation and an optical system for correction of the focal distance to focus the laser light projected for the scanning by the scanning mirror, the scanning mirror is continuously driven, and the actual drawing is conducted by activating oscillation of the laser light and scanning with the laser light only when the locus of the laser beam supposed to be formed if the oscillation of the laser light would be activated (the virtual laser beam) is moving substantially at a constant speed.

Specifically, when a line is drawn, the driving of the scanning mirror is adjusted in a manner such that the scanning mirror is driven at a position some distance before the starting point of the line while the laser oscillator is kept switched off and is driven substantially at a constant speed when the virtual laser light (the locus of the laser beam supposed to be formed if the oscillator would be switched on and the oscillation of the laser light would be activated) reaches the starting point of the line. When the virtual laser beam reaches the starting point of the line, the laser oscillator is switched on, and the drawing is started. The scanning mirror moves substantially at the constant speed during the drawing.

At the ending point of the line, the laser oscillator is switched off, and the drawing is stopped. The driving of the galvanomirror is adjusted in a manner such that the virtual laser beam reaches the starting point of the next line at the same speed of driving or at a different speed of driving while the scanning mirror is kept being driven.

In accordance with a scanning with conventional scanning mode, the areas in the vicinity of the starting point and the ending point are irradiated with the laser energy in an excess amount as described above. In contrast, the above problem can be overcome in accordance with the scanning with Virtual scanning/Passing-through Mode.

Figure 2:
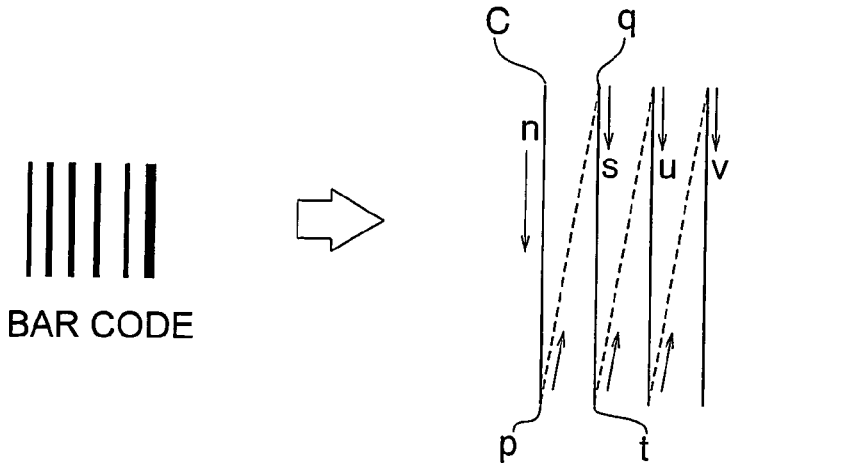
FIG. 2 shows a diagram describing an example of a process for recording adjacent lines in drawing a bar code with a conventional scanning mode.

FIG. 2 shows a diagram describing an example of a process for recording adjacent lines in drawing a bar code using a conventional scanning mode.

As the first step, scanning with the scanning mirror is started and, then, suspended for a moment when the virtual laser beam reaches the starting point C. Then, the scanning with the scanning mirror is resumed. The laser oscillator is switched on to start the irradiation with laser beam, and the line n is drawn. When the scanning mirror reaches the point p, the scanning with the scanning mirror is stopped, and the laser oscillator is switched off, simultaneously. The scanning with the scanning mirror is resumed and, then, suspended for a moment when the virtual laser beam reaches the starting point q of the next line. Then, the scanning with the scanning mirror is resumed. The laser oscillator is switched on to start the irradiation with laser beam, and the line s is drawn. When the scanning mirror reaches the point t, the scanning with the scanning mirror is stopped, and the laser oscillator is switched off, simultaneously. The lines u and v are drawn in accordance with the same procedures as those described above.

Figure 3:
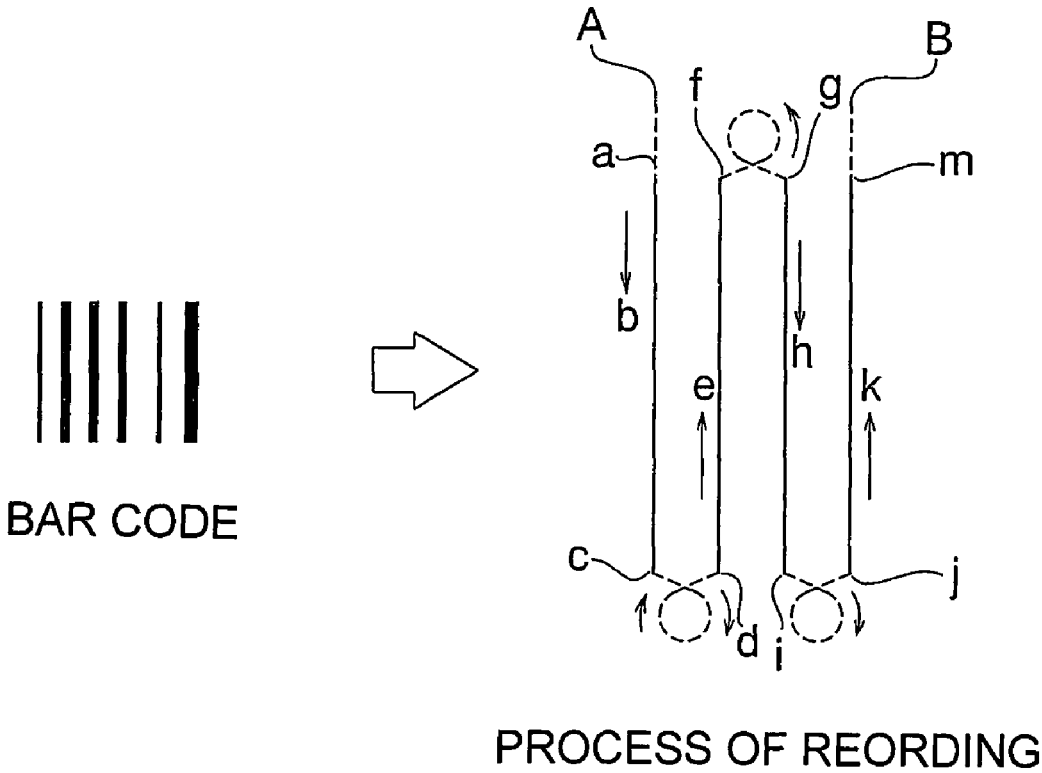
FIG. 3 shows a diagram describing an example of a process for recording adjacent lines with Virtual scanning/Passing-through Mode in drawing a bar code.

FIG. 3 shows a diagram describing an example of a process for recording adjacent lines in drawing a bar code using scanning with Virtual scanning/Passing-through Mode.

In FIG. 3, the driving of the scanning mirror is started at the point A. The laser oscillator is switched on to start the drawing when the virtual laser beam reaches the starting point a, and the line b is drawn. When the scanning mirror reaches the point c, the laser oscillator is switched off, and the scanning mirror is driven in a manner such that the virtual laser beam moves along a loop shown by the broken line. When the virtual laser beam reaches the point d, the laser oscillator is switched on to resume the drawing, and the line e is drawn.

Then, the laser oscillator is switched off at the point f, and the scanning mirror is driven in a manner such that the virtual laser beam moves along a loop shown by the broken line. When the virtual laser beam reaches the point g, the laser oscillator is switched on to resume the drawing, and the line h is drawn. The laser oscillator is switched off at the point i, and the scanning mirror is driven in a manner such that the virtual laser beam moves along a loop shown by the broken line. When the virtual laser beam reaches the point j, the laser oscillator is switched on to resume the drawing, and the line k is drawn. At the point m which is the ending point of the character, the laser oscillator is switched off, and the drawing is completed.

The driving of the scanning mirror is stopped when the virtual laser beam moves along the broken line and reaches the point B. A bar code is recorded in the manner described above.

The scanning mirror moves substantially at a constant speed while the laser oscillator is switched on.

The conventional scanning mode and Virtual scanning/Passing-through Mode described above can also be applied to drawing lines adjacent to each other and overlapping each other.

Recording process 1 can be applied to drawing any of characters, bar codes, solid images and figures.

Recording process 2 of the present invention can be applied to drawing lines adjacent to each other and overlapping each other. In recording process 2, it is preferable that, when lines which are adjacent to each other and overlapping each other are drawn by scanning with laser light, and a second line is drawn after a first line is drawn, the scanning with laser light is conducted in a manner such that the width of the overlapped portion between the first line and the second line is 0 to 60 μm. When the width of the overlapped portion (r in FIG. 1) is 0 to 60 μm, the density of the recording can be maintained without decrease. When the width of overlapped portions exceeds 60 μm, the remaining heat formed by drawing the first line tends to cause elimination of the second line drawn in the next step, and there is the possibility that the visibility decreases.

Moreover, when the area of the overlapped portion is excessively great, heat occasionally causes damage on the substrate. When the lines are separated from each other without overlapped portions, i.e., the width of overlapped portions is smaller than 0 μm, it is difficult that the group of lines is recognized as a broad line, and the optical readability of the bar code decreases. It is more preferable that the width of overlapped portions is 3 to 50 μm and most preferably 3 to 40 μm.

In recording process 2, the scanning with Virtual scanning/Passing-through Mode is preferable as the mode of scanning with laser light similarly to recording process 1. Recording process 2 can be applied to drawing images such as bar codes and solid images.

In the recording process of the present invention, it is necessary that the distance between the surface of the recording medium and the source of the laser light in the recording be selected with consideration on prevention of degradation of the substrate, the density of characters (the readability of bar codes) and the size of characters although the distance may be different depending on the scanning speed and the output of irradiation. In the recording, it is preferable that the output of laser is 2.0 to 3.6 W, the distance of irradiation is 145 to 210 mm, and the duty is 65 to 100%.

In accordance with the recording process of the present invention (recording processes 1 and 2), discoloration of line elements is suppressed, and decreases in readability and visibility of bar codes, for example, can be suppressed when a plurality of line elements which are adjacent to each other or are adjacent to each other and overlapping each other are recorded in the process for recording characters, bar codes, solid images and figures into a rewritable recording medium of the non-contact type.

An excellent image can be obtained by rapidly cooling the image by blowing with the cool air or the like after the irradiation with the laser beam for recording has been made. As for the cooling operation, the scanning with the laser beam and the rapid cooling may be conducted alternately or simultaneously.

The erasure of a recorded image in the method of the present invention is conducted so that the information on the rewritable recording medium can be replaced with a new information. For the erasure, the surface of the recording medium having a recorded information is irradiated with a near infrared laser beam of 700 to 1,400 nm. The amount of the remaining image can be further decreased by further decreasing the cooling rate in accordance with a method of bringing the image into contact with a heated roll or a method of blowing the heated air to the image in combination with the irradiation with the laser beam having a prescribed amount of energy.

Any conventional heated roll can be used without restrictions as long as the heated roll can heat the surface of the label at about 100 to 140° C. within 4 seconds after starting the irradiation with the laser beam for the erasure and the surface of the label is not damaged. For example, a rubber roll or a stainless steel roll can be used. In particular, a silicone rubber roll exhibiting excellent heat resistance is preferable. The hardness of the rubber is preferably 40 degrees or greater. When a soft rubber roll having a hardness smaller than 40 degrees is used, adhesion to the light absorption and heat conversion layer increases, and there is the possibility that the light absorption and heat conversion layer is attached to and cleaved with the rubber roll.

A recorded image can also be erased by blowing the heated air to the image. In this case, the air heated at about 80 to 140° C. is supplied for 10 to 60 seconds.

The rewritable recording medium of the non-contact type used in the recording process of the present invention will be described in the following.

The rewritable recording medium of the non-contact type used in the recording process of the present invention has a structure having a reversible heat sensitive color developing layer disposed on the surface of a substrate. The substrate in the recording medium is not particularly limited. Examples of the substrate include plastic films such as films of polystyrene, acrylonitrile-butadiene-styrene resins, polycarbonates, polypropylene, polyethylene, polyethylene terephthalate and polyethylene naphthalate, synthetic paper, non-woven fabrics and paper. It is preferable that a substrate based on the same material as the adherend is used since the recording medium can be recycled in combination with the adherend. The thickness of the substrate is not particularly limited. The thickness is, in general, in the range of 10 to 500 μm and preferably in the range of 20 to 200 μm.

The reversible heat sensitive color developing layer formed on the surface of the substrate is, in general, constituted with a colorless or slightly colored dye precursor, a reversible color developing agent and components used where necessary such as binders, accelerators for erasure of color, inorganic pigments and various additives.

The dye precursor is not particularly limited, and a compound can be suitably selected as desired from compounds conventionally used as the dye precursor in conventional heat sensitive recording materials. For example, at least one compound selected from triarylmethane-based compounds, xanthene-based compounds, diphenylmethane-based compounds and thiazine-based compounds can be used.

The color developing agent is not particularly limited as long as the color developing agent reversibly changes the color tone of the dye precursor by the difference in the rate of cooling after heating. Electron accepting compounds comprising phenol derivatives having a long chain alkyl group are preferable from the standpoint of the density of the developed color, the property for erasing the color and durability in repeated operations.

The phenol derivative may have atoms such as oxygen atom and sulfur atom and amide bond in the molecule. The length and the number of the alkyl group are selected with consideration on the balance between the property for erasing the color and the property for developing the color. It is preferable that the number of carbon atom in the alkyl group is 8 or greater and more preferably about 8 to 24. Hydrazine compounds, anilide compounds and urea compounds having a long chain alkyl group as the side chain can also be used.

When information is recorded utilizing the crystallizing property of the reversible color developing agent, recording and erasure of the information can be conducted repeatedly by the rapid cooling after heating for the recording of the information and by the slow cooling after heating for the erasure of the information.

Relative amounts of the dye precursor and the reversible color developing agent are not particularly limited. The reversible color developing agent is used, in general, in an amount of 50 to 700 parts by mass and preferably in an amount of 100 to 500 parts by mass per 100 parts by mass of the dye precursor.

The thickness of the heat sensitive color developing layer is, in general, 1 to 10 μm and preferably 2 to 7 μm.

In the rewritable recording medium used in the present invention, the heat sensitive color developing layer may comprise an agent for light absorption and heat conversion or a light absorption and heat conversion layer comprising an agent for light absorption and heat conversion may be formed on the heat sensitive color developing layer.

The agent for light absorption and heat conversion exhibits the function of absorbing laser light supplied by the irradiation and converting the light into heat and can be suitably selected in accordance with the used laser light. As the laser light, it is preferable that laser light having a wavelength of oscillation in the range of 700 to 1400 nm is selected from the standpoint of the convenience of the apparatus and the property for scanning. For example, semiconductor laser light (830 nm) and YAG laser light (1064 nm) are preferable.

The agent for light absorption and heat conversion absorbs laser light in the near infrared range and converts the absorbed light into heat, and it is preferable that the agent does not absorb light in the visible range. When the light in the visible range is absorbed, the visibility and the readability of bar codes decrease. As the agent for light absorption and heat conversion satisfying the above requirement, organic dyes and/or organometal-based coloring agents are used. Specifically, for example, at least one agent selected from cyanine-based coloring agents, phthalocyanine-based coloring agents, anthraquinone-based coloring agents, azulene-based coloring agents, squalirium-based coloring agents, metal complex-based coloring agents, triphenylmethane-based coloring agents and indolenylene-based coloring agents is used. Among these coloring agents, indolenylene-based agents are preferable due to the excellent property for converting light into heat.

When the heat sensitive color developing layer comprises the agent for light absorption and heat conversion, the content is not particularly limited. The content is, in general, 0.1 to 10% by mass, preferably 0.1 to 5% by mass and more preferably 0.5 to 3% by mass.

When the light absorption and heat conversion layer is formed on the heat sensitive color developing layer, in general, the light absorption and heat conversion layer is constituted with the agent for light absorption and heat conversion, binder and other components used where desired such as inorganic pigments, antistatic agents and other additives. The thickness of the light absorption and heat conversion layer is, in general, in the range of 0.05 to 10 μm and preferably in the range 0.1 to 3 μm.

In the rewritable recording medium of the non-contact type used in the present invention, it is preferable that the heat sensitive color developing layer comprises the agent for light absorption and heat conversion or the light absorption and heat conversion layer is formed on the heat sensitive color developing layer and that the absorption rate of the laser light with the surface of the recording medium is 40% or greater. When the absorption rate of the laser light is 40% or greater, the energy of irradiation at the surface of the recording medium is sufficient. Therefore, clear recording can be achieved in the recording, and complete erasure can be achieved in the erasure. The absorption rate of light is more preferably 50% or greater and most preferably 60% or greater. In the present invention, the absorption rate of the laser light is calculated from the values of percent transmission and percent reflection determined for a prescribed laser light in accordance with the method standardized in JIS (JAPANESE INDUSTRIAL STANDARD) K 0115 from the following equation:

$$100\% - (\text{percent transmittance} + \text{percent reflectance}) = \text{absorption rate of laser light}(\%)$$

Using the rewritable recording medium of the non-contact type described above, the color of the reversible heat sensitive color developing layer may be developed or erased by the heat generated by the optical stimuli via the agent for light absorption and heat conversion, and rewriting can be conducted by repeating the recording (the printing) and the erasure without contact.

In the rewritable recording medium of the non-contact type used in the present invention, an adhesive layer may be formed on the surface of the substrate opposite to the face having the reversible heat sensitive color developing layer. It is preferable that the adhesive layer is a pressure sensitive adhesive layer from the standpoint of the convenience for attaching to an adherend.

It is preferable that the pressure sensitive adhesive forming the pressure sensitive adhesive layer exhibits excellent adhesive property to an adherend made of a plastic material and has a resin composition which does not adversely affect recycling when the adherend and the recording medium are recycled in combination. In particular, adhesives comprising acrylic ester-based copolymers as the resin component are advantageously used due to the excellent property for recycling. Rubber-based pressure sensitive adhesives, polyester-based pressure sensitive adhesives, polyurethane-based pressure sensitive adhesives and silicone-based pressure sensitive adhesives can also be used. The thickness of the pressure sensitive adhesive layer is, in general, 5 to 60 μm and preferably 15 to 40 μm.

A release sheet may be formed on the pressure sensitive adhesive layer, where necessary.

EXAMPLES

The present invention will be described more specifically with reference to examples in the following. However, the present invention is not limited to the examples.

The method for recording (printing) and the method for evaluation of the results in the Examples and the Comparative Examples are shown in the following.

(1) Method for Recording (Printing)

Using a YAG laser (the wavelength: 1064 nm) [manufactured by SUNX Co., Ltd.; the trade name: "LP-V10"] as the laser marker used for irradiation with laser, recording of a one-dimensional bar code and a solid image was conducted.

Experiments in Examples and Comparative Examples were conducted by changing the time between the starting point of drawing the previous line and the ending point of drawing the adjacent next line and the overlapping distance between the adjacent lines by adjusting the scanning speed and the sizes of the one-dimensional bar code and the solid image while the distance of irradiation was adjusted at 180 mm, the output of the laser was adjusted at 2.5 W, and the duty was adjusted at 100%.

<Recording (Printing) with Conventional Scanning Mode>

The driving of the scanning mirror was started at the point C, and the laser oscillator was switched on to start the drawing. The line n was drawn. The laser oscillator was switched off at the point p, and the scanning with the scanning mirror was switched off. Then, the scanning mirror was moved in a manner such that the locus shown by the broken line was produced. When the scanning mirror reached the starting point of the next line q, the scanning mirror and the laser oscillator were switched on, simultaneously. The next line s was drawn. A broad line could be drawn by placing the line n and the line s in a manner such that the lines overlap each other. (Refer to FIG. 2.)

<Recording (Printing) with Virtual Scanning/Passing-Through Mode>

Driving of the scanning mirror was started at the point A. When the virtual laser beam reached the starting point a, the laser oscillator was switched on, and the line b was drawn. At the point c, the laser oscillator was switched off, and the scanning mirror was moved in a manner such that the virtual laser beam draws a loop shown by the broken line. When the virtual laser beam reached the point d, the laser oscillator was switched on to resume the drawing, and the line e was drawn. A broad line could be drawn by placing the line b and the line e in a manner such that the lines overlap each other. (Refer to FIG. 3.)

(2) Evaluation of the Result

In Examples and Comparative Examples, a one-dimensional bar code of Code 39 (the narrow bar: 0.3 mm; the ratio: 2.5; the recorded information: 0123) and a solid image were recorded, and the result was evaluated in accordance with the methods and the criteria shown in the following.

Code 39: a code system of the one-dimensional bar code

Narrow bar: The width of a narrow element of Code 39

Ratio: the ratio of the width of the broad element to the width of the narrow element of Code 39 (the width of the broad element/the width of the narrow element)

<Methods and Criteria for the Evaluation>

Density of a printed image: The density of a printed image was measured using an optical densitometer [MACBETH RD918][manufactured by MACBETH Co., Ltd.]

An optical density of 0.65 or greater: The density of the drawn line was great and clear, and the visibility was good.

An optical density of 0.64 or smaller: The density of the drawn line was small, and the visibility was poor.

Property for accurate reading of a bar code: the property for accurate reading of a bar code was evaluated in accordance with the method of the ANSI standard; (excellent) A>B>C>D>F (poor)

Result of printing: The result of printing was evaluated in accordance with the following criterion; (excellent) 4>3>2>1 (poor)

4: A very clearly drawn line; the drawn lines accurately distinguished by visual observation and by using a bar code reader; and no uneven distribution of the density found.

3: The drawn lines almost accurately distinguished by visual observation and by using a bar code reader; and slightly uneven distribution of the density found.

2: Distinguishing drawn lines by visual observation difficult; frequent erroneous reading by the bar code reader; and uneven distribution of the density found.

1: Distinguishing drawn lines not possible either by visual observation or by using a bar code reader.

Preparation Example 1

Ten parts by mass of 3-(4-diethylamino-2-ethoxyphenyl)-3-(1-ethyl-2-methylindol-3-yl)-4-azaphthalide, which was a triarylmethane-based compound, as the dye precursor, 30 parts by mass of 4-(N-methyl-N-octadecylsulfonylamino) phenol as the reversible color developing agent, 1.5 parts by mass of polyvinyl acetal as the dispersant and 2,500 parts by mass of tetrahydrofuran as the diluting solvent were pulverized and dispersed by a pulverizer and a disper, and a coating fluid for forming a heat sensitive color developing layer (Fluid A) was prepared.

Preparation Example 2

One part by mass of an agent for near infrared light absorption and heat conversion (a nickel complex-based coloring agent) [manufactured by TOSCO Co., Ltd.; the trade name: "SDA-5131"], 100 parts by mass of a binder of the ultraviolet light curing type (a urethane acrylate) [manufactured by DAINICHI SEIKA KOGYO Co., Ltd.; the trade name: "PU-5(NS)"] and 3 parts by mass of an inorganic pigment (silica) [manufactured by NIPPON AEROSIL KOGYO Co., Ltd.; the trade name: "AEROSIL R-972"] were dispersed by a disper, and a coating fluid for forming a light absorption and heat conversion layer (Fluid B) was prepared.

Example 1

The face treated for adhesion of a foamed film of polyethylene terephthalate having a thickness of 100 μm [manufactured by TOYOBO Co., Ltd.; the trade name: "CRISPER 50K2411"] used as the substrate was coated with Fluid A prepared in Preparation Example 1 in accordance with the gravure process in an amount such that the thickness was 4 μm after being dried. The formed coating layer was dried in an oven at 60° C. for 5 minutes, and a heat sensitive color developing layer was formed. The formed heat sensitive color developing layer was then coated with Fluid B prepared in Preparation Example 2 in accordance with the flexo process in an amount such that the thickness was 1.2 μm after being dried. The formed coating layer was dried in an oven at 60° C. for 1 minute and then irradiated with ultraviolet light in an amount of 220 mJ/cm$^2$, and a light absorption and heat conversion layer was formed.

The absorption rate of laser light was 60%. The absorption rate of laser light was obtained by measuring the percent transmittance and the percent reflectance of the laser light used for recording in accordance with the method standardized in JIS K0115 using an ultraviolet visible spectrophotometer [manufactured by SHIMADZU CORPORATION; the trade name: "MPC-3100"], followed by calculation in accordance with the following equation:

$$100\%-(\text{percent transmittance}+\text{percent reflectance})=\text{absorption rate of laser light}\ (\%).$$

The width of the overlapped portion of adjacent lines was set at 20 μm in a bar code of code 39 used as the image for drawing. As the condition of scanning with laser, the length of the line was adjusted at 2 mm and the time for drawing the solid line was adjusted at 2,500 mm/sec so that the time from drawing the starting point of the previous line to drawing the ending point of the adjacent next line was 1.8 msec, and the test of recording was conducted in accordance with the conventional printing process.

Example 2

The same procedures as those conducted in Example 1 were conducted except that the width of the overlapped portion of adjacent lines was set at 20 μm in a bar code of Code 39 used as the image for drawing; as the condition of scanning with laser, the length of the line was adjusted at 2 mm and the time for drawing the solid line was adjusted at 2,500 mm/sec so that the time from drawing the starting point of the previous line to drawing the ending point of the adjacent next line was 1.8 msec; and the test of recording was conducted in accordance with scanning with Virtual scanning/Passing-through Mode.

Example 3

The same procedures as those conducted in Example 1 were conducted except that the width of the overlapped portion of adjacent lines was set at 20 μm in a bar code of code 39 used as the image for drawing; as the condition of scanning with laser, the length of the line was adjusted at 10 mm and the time for drawing the solid line was adjusted at 2,500 mm/sec so that the time from drawing the starting point of the previous line to drawing the ending point of the adjacent next line was 9.0 msec; and the test of recording was conducted in accordance with scanning with Virtual scanning/Passing-through Mode.

Example 4

The same procedures as those conducted in Example 1 were conducted except that the width of the overlapped portion of adjacent lines was set at 20 μm in a bar code of code 39 used as the image for drawing; as the condition of scanning with laser, the length of the line was adjusted at 20 mm and the time for drawing the solid line was adjusted at 2,500 mm/sec so that the time from drawing the starting point of the previous line to drawing the ending point of the adjacent next line was 18 msec; and the test of recording was conducted in accordance with scanning with Virtual scanning/Passing-through Mode.

Example 5

The same procedures as those conducted in Example 1 were conducted except that the width of the overlapped portion of adjacent lines was set at 20 μm in a bar code of code 39 used as the image for drawing; as the condition of scanning with laser, the length of the line was adjusted at 35 mm and the time for drawing the solid line was adjusted at 2,500 mm/sec so that the time from drawing the starting point of the previous line to drawing the ending point of the adjacent next line was 29 msec; and the test of recording was conducted in accordance with scanning with Virtual scanning/Passing-through Mode.

Example 6

The same procedures as those conducted in Example 1 were conducted except that the width of the overlapped portion of adjacent lines was set at 50 μm in a bar code of code 39 used as the image for drawing; as the condition of scanning with laser, the length of the line was adjusted at 10 mm and the time for drawing the solid line was adjusted at 2,500 mm/sec so that the time from drawing the starting point of the previous line to drawing the ending point of the adjacent next line was 9.0 msec; and the test of recording was conducted in accordance with scanning with Virtual scanning/Passing-through Mode.

Example 7

The same procedures as those conducted in Example 1 were conducted except that the width of the overlapped portion of adjacent lines was set at 10 μm in a bar code of code 39 used as the image for drawing; as the condition of scanning with laser, the length of the line was adjusted at 10 mm and the time for drawing the solid line was adjusted at 2,500 mm/sec so that the time from drawing the starting point of the previous line to drawing the ending point of the adjacent next line was 9.0 msec; and the test of recording was conducted in accordance with scanning with Virtual scanning/Passing-through Mode.

Example 8

The same procedures as those conducted in Example 1 were conducted except that the width of the overlapped portion of adjacent lines was set at 70 μm in a bar code of code 39 used as the image for drawing; as the condition of scanning with laser, the length of the line was adjusted at 20 mm and the time for drawing the solid line was adjusted at 2,500 mm/sec so that the time from drawing the starting point of the previous line to drawing the ending point of the adjacent next line was 18 msec; and the test of recording was conducted in accordance with scanning with Virtual scanning/Passing-through Mode.

Example 9

The same procedures as those conducted in Example 1 were conducted except that the width of the overlapped portion of adjacent lines was set at 0 μm in a bar code of code 39 used as the image for drawing; as the condition of scanning with laser, the length of the line was adjusted at 10 mm and the time for drawing the solid line was adjusted at 2,500 mm/sec so that the time from drawing the starting point of the previous line to drawing the ending point of the adjacent next line was 9.0 msec; and the test of recording was conducted in accordance with scanning with Virtual scanning/Passing-through Mode.

Example 10

The same procedures as those conducted in Example 1 were conducted except that the width of the overlapped portion of adjacent lines was set at 20 μm in a bar code of code 39 used as the image for drawing; as the condition of scanning with laser, the length of the line was adjusted at 45 mm and the time for drawing the solid line was adjusted at 2,000 mm/sec so that the time from drawing the starting point of the previous line to drawing the ending point of the adjacent next line was 38 msec; and the test of recording was conducted in accordance with scanning with Virtual scanning/Passing-through Mode.

Example 11

The same procedures as those conducted in Example 1 were conducted except that the width of the overlapped portion of adjacent lines was set at 20 μm in a bar code of code 39 used as the image for drawing; as the condition of scanning with laser, the length of the line was adjusted at 0.5 mm and the time for drawing the solid line was adjusted at 6,000 mm/sec so that the time from drawing the starting point of the previous line to drawing the ending point of the adjacent next line was 0.18 msec; and the test of recording was conducted in accordance with scanning with Virtual scanning/Passing-through Mode.

Comparative Example 1

The same procedures as those conducted in Example 1 were conducted except that the width of the overlapped portion of adjacent lines was set at 70 μm in a bar code of code 39 used as the image for drawing; as the condition of scanning with laser, the length of the line was adjusted at 0.5 mm and the time for drawing the solid line was adjusted at 6,000 mm/sec so that the time from drawing the starting point of the previous line to drawing the ending point of the adjacent next line was 0.18 msec; and the test of recording was conducted in accordance with scanning with Virtual scanning/Passing-through Mode.

Comparative Example 2

The same procedures as those conducted in Example 1 were conducted except that the width of the overlapped portion of adjacent lines was set at 70 μm in a bar code of code 39 used as the image for drawing; as the condition of scanning with laser, the length of the line was adjusted at 45 mm and the time for drawing the solid line was adjusted at 2,500 mm/sec so that the time from drawing the starting point of the previous line to drawing the ending point of the adjacent next line was 38 msec; and the test of recording was conducted in accordance with scanning with Virtual scanning/Passing-through Mode.

Comparative Example 3

The same procedures as those conducted in Example 1 were conducted except that the width of the overlapped portion of adjacent lines was set at −10 μm (separated by 10 μm) in a bar code of code 39 used as the image for drawing; as the condition of scanning with laser, the length of the line was adjusted at 0.5 mm and the time for drawing the solid line was adjusted at 6,000 mm/sec so that the time from drawing the starting point of the previous line to drawing the ending point of the adjacent next line was 0.18 msec; and the test of recording was conducted in accordance with scanning with Virtual scanning/Passing-through Mode.

Comparative Example 4

The same procedures as those conducted in Example 1 were conducted except that the width of the overlapped portion of adjacent lines was set at −10 μm in a bar code of code 39 used as the image for drawing; as the condition of scanning with laser, the length of the line was adjusted at 45 mm and the time for drawing the solid line was adjusted at 2,500 mm/sec so that the time from drawing the starting point of the previous line to drawing the ending point of the adjacent next line was 38 msec; and the test of recording was conducted in accordance with scanning with Virtual scanning/Passing-through Mode.

The printing process, the time for the entire printing (the time from drawing the starting point of the previous line to drawing the ending point of the next line), the width of the overlapped portion and the property for recording (the density of printing, the readability of the bar code and the result of printing) are shown in Table 1.

TABLE 1

| | Scanning mode* | Time for entire printing (msec) | Width of overlapped portion (μm) | Property for recording | | |
|---|---|---|---|---|---|---|
| | | | | density of printing | readability of bar code | result of printing |
| Example 1 | conventional | 1.8 | 20 | 0.88 | A | 3 |
| Example 2 | V/P | 1.8 | 20 | 0.88 | A | 4 |
| Example 3 | V/P | 9.0 | 20 | 0.85 | A | 4 |
| Example 4 | V/P | 18 | 20 | 0.85 | A | 4 |
| Example 5 | V/P | 29 | 20 | 0.85 | A | 4 |
| Example 6 | V/P | 9.0 | 50 | 0.87 | A | 4 |
| Example 7 | V/P | 9.0 | 10 | 0.88 | A | 3 |
| Example 8 | V/P | 18 | 80 | 0.76 | C | 4 |
| Example 9 | V/P | 9.0 | 0 | 0.90 | A | 4 |
| Example 10 | V/P | 38 | 20 | 0.85 | A | 4 |
| Example 11 | V/P | 0.18 | 20 | 0.70 | C | 3 |
| C. Ex 1** | V/P | 0.18 | 70 | 0.59 | F | 1 |
| C. Ex 2 | V/P | 38 | 70 | 0.57 | D | 2 |
| C. Ex 3 | V/P | 0.18 | −10 | 0.28 | F | 1 |
| C. Ex 4 | V/P | 38 | −10 | 0.50 | F | 1 |

*conventional: scanning with conventional scanning mode
V/P: scanning with Virtual scanning/Passing-through Mode
**C. Ex: Comparative Example

INDUSTRIAL APPLICABILITY

In accordance with the process for recording into a rewritable recording medium of the non-contact type of the present invention, when a plurality of line elements which are adjacent to each other or are adjacent to each other and overlapping each other are recorded in the recording process for drawing characters, bar codes, solid images or figures into the above recording medium, discoloration of line elements is suppressed, and decreases in readability and visibility of bar codes, for example, can be suppressed

What is claimed is:

1. A process for recording by drawing lines which are adjacent to each other or are adjacent to each other and overlapping each other into a rewritable recording medium of a non-contact type having a reversible heat sensitive color developing layer disposed on a surface of a substrate by scanning the rewritable recording medium with a laser light wherein the process comprises drawing a first line, and then drawing a second line after the first line has been drawn by controlling the following:

(i) a time between starting the drawing of the first line and ending the drawing of the second line, or (ii) a width of an overlapped portion between the first line and the second line, or (iii) a time between starting the drawing of the first line and ending the drawing of the second line and a width of an overlapped portion between the first line and the second line, thereby suppressing discoloration of the recorded lines by interference between heat remaining after the first line has been drawn and heat generated while the second line is drawn, and wherein the laser light is from a YAG laser and an output of the laser light is 2.0 to 3.6 W.

2. The process according to claim 1, wherein the time between starting the drawing of the first line and ending the drawing of the second line is 0.2 to 34 msec.

3. The process according to claim 1, wherein the width of an overlapped portion between the first line and the second line is 0 to 60 μm.

4. The process according to claim 1, wherein the scanning with the laser light is conducted by using an apparatus for scanning with light comprising a source of laser light, a scanning mirror which is operable to be driven for rotation and is used for scanning with the laser light emitted from the source by oscillation and an optical system for correction of the focal distance to focus the laser light into a laser beam projected for the scanning by the scanning mirror and in a manner such that when a prescribed drawing is conducted by irradiation of a rewritable recording medium with the laser beam, the scanning mirror is continuously driven, and an actual drawing is conducted by activating oscillation of the laser light and scanning with the laser light only when the locus of the laser beam supposed to be formed if the oscillation of the laser light would be activated (a virtual laser beam) is moving substantially at a constant speed.

5. The process according to claim 1, wherein the rewritable recording medium of a non-contact type comprises an agent for light absorption and heat conversion comprised in the reversible heat sensitive color developing layer or a light absorption and heat conversion layer comprising an agent for light absorption and heat conversion disposed on the reversible heat sensitive color developing layer, and has a light absorption rate of laser light at a surface of the recording medium of 40% or greater, said light absorption rate of laser light being calculated from the following formula:

$$100\%-(\text{percent transmittance}+\text{percent reflectance})=\text{absorption rate of laser light }(\%),$$

wherein the percent transmittance and the percent reflectance are values determined in accordance with JIS K0115 for the laser light used for the recording.

6. The process according to claim 1, wherein the rewritable recording medium of a non-contact type comprises an adhesive layer disposed on a surface of the substrate opposite to a face having the reversible heat sensitive color developing layer.

7. The process according to claim 1, wherein the time between starting the drawing of the first line and ending the drawing of the second line is 0.2 to 34 msec and the width of the overlapped portion between the first line and the second line is 0 to 60 μm.

8. The process according to claim 1, wherein the lines drawn by the process are lines in a bar code.

* * * * *